US010836607B2

(12) United States Patent
Woodhams

(10) Patent No.: US 10,836,607 B2
(45) Date of Patent: Nov. 17, 2020

(54) STAIRLIFTS

(71) Applicant: Stannah Stairlifts Limited, Hampshire (GB)

(72) Inventor: Max Daniel Woodhams, Hampshire (GB)

(73) Assignee: Stannah Stairlifts Limited, Hampshire (GB)

( * ) Notice: Subject to any disclaimer, the term of this patent is extended or adjusted under 35 U.S.C. 154(b) by 0 days.

(21) Appl. No.: 16/096,509

(22) PCT Filed: Apr. 25, 2017

(86) PCT No.: PCT/GB2017/051153
§ 371 (c)(1),
(2) Date: Oct. 25, 2018

(87) PCT Pub. No.: WO2017/187161
PCT Pub. Date: Nov. 2, 2017

(65) Prior Publication Data
US 2019/0112157 A1 Apr. 18, 2019

(30) Foreign Application Priority Data
Apr. 25, 2016 (GB) ..... 1607136.7

(51) Int. Cl.
*B66B 9/08* (2006.01)

(52) U.S. Cl.
CPC ..... *B66B 9/0846* (2013.01)

(58) Field of Classification Search
CPC ..... B66B 9/0846; B66B 9/0853
See application file for complete search history.

(56) References Cited

U.S. PATENT DOCUMENTS 1,237,627 A * 8/1917 Forbes ..... B66B 9/083 187/201
5,052,521 A 10/1991 Wendt et al.
8,607,936 B2 * 12/2013 Szentistvany ..... B66B 9/0838 104/230
2007/0272488 A1 * 11/2007 Woodhams ..... B66B 9/0846 187/201
2011/0088977 A1 * 4/2011 Woodhams ..... B66B 9/08 187/201
2014/0083801 A1 * 3/2014 Vroegindeweij ..... B66B 9/0815 187/201
2015/0034423 A1 * 2/2015 Ooms ..... B66B 9/0846 187/201
2015/0059965 A1 * 3/2015 Geurts ..... B66B 9/0846 156/196

(Continued)

FOREIGN PATENT DOCUMENTS

CN 201737561 U 2/2011
CN 204549744 U 8/2015

(Continued)

OTHER PUBLICATIONS

JP2000034077—Machine translation (Year: 2000).*

*Primary Examiner* — Michael A Riegelman
(74) *Attorney, Agent, or Firm* — Dinsmore & Shohl LLP

(57) ABSTRACT

A stairlift rail is configured to cause a stairlift carriage and chair to rotate a small amount in a downhill direction adjacent to the lower end of the rail, thus avoiding a clash between the chair and the staircase.

6 Claims, 3 Drawing Sheets

(56) References Cited

U.S. PATENT DOCUMENTS

| | | | | |
|---|---|---|---|---|
| 2016/0236906 | A1* | 8/2016 | Horton | B66B 9/0846 |
| 2016/0304318 | A1* | 10/2016 | McGill | B66B 9/0846 |
| 2017/0233223 | A1* | 8/2017 | Hoedjes | B66B 9/0838<br>187/201 |
| 2019/0112157 | A1* | 4/2019 | Woodhams | B66B 9/0846 |
| 2019/0185294 | A1* | 6/2019 | Sbrana | B66B 7/022 |

FOREIGN PATENT DOCUMENTS

| | | | |
|---|---|---|---|
| EP | 1720790 | B1 | 8/2014 |
| GB | 2484709 | A | 4/2012 |
| JP | H08119560 | A | 5/1996 |
| JP | 2000034077 | A | 2/2000 |
| JP | 2003267645 | A | 9/2003 |
| JP | 2003312966 | A | 11/2003 |
| WO | 2016072849 | A1 | 5/2016 |

* cited by examiner

STAIRLIFTS

CROSS-REFERENCE TO RELATED APPLICATIONS

This application is the U.S. national stage of PCT/GB2017/051153 filed Apr. 25, 2017, which claims priority of United Kingdom Patent Application 1607136.7 filed Apr. 25, 2016 each of which is hereby incorporated by reference in its entirety.

FIELD OF THE INVENTION

This invention relates to stairlifts. More particularly, the invention relates to a novel form of rail for incorporation into a stairlift assembly, and to a stairlift installation incorporating such a rail.

BACKGROUND OF THE INVENTION

As is well known, a stairlift installation broadly comprises a rail which is mounted on a staircase to extend between a lower floor and an upper floor, a carriage mounted on the rail for movement between the floors, and a chair mounted on the carriage. The chair typically includes a seat base, a backrest, two armrests and a footrest.

On straight stairlifts the position of the chair relative to the carriage is fixed. On curved stairlifts relative movement between the chair and the carriage is effected, as the carriage passes along the rail, to maintain the chair level at all times.

Configuring a stairlift installation necessarily involves a number of compromises so that the user can make easy and efficient use the stairlift while able-bodied persons can go about their normal activities within the building in which the stairlift is installed, with minimal interference.

An obvious requirement is that it should be easy for a user to get on and off the stairlift. In order to achieve this, traditionally the stairlift rail is extended down to floor level at the lower end of the installation. However, in many buildings, this extension of the rail will overlie a walkway or doorway and thus inhibit or prevent normal foot traffic. In the past this problem has been addressed by mounting a lower section of the rail so that it can be displaced into a non-obstructing position when the stairlift is not in use.

In our European Patent No. 1 720 790 we describe a solution to the above problem wherein a stairlift rail is disclosed, the lower end of which is a fixed integral part of the rail but is angled downwardly relative to the remainder or upper section of the rail and may be fixed, at least in part, to the first step of the staircase. By suitably configuring the carriage, this allows the chair to move substantially vertically at the lower end of its travel until the footrest of the chair is closely adjacent to the lower floor level; but the rail itself does not project to any significant extent beyond the lower edge of the staircase.

The form of rail disclosed in EP 1 720 790 eliminates the need for hinges or folding mechanisms but we have found that, in some installations, the footrest snags the staircase as the carriage leaves the lower section of rail and transitions onto the upper section of rail. Particular clashing or snagging problems will vary from installation to installation and thus a change in configuration and/or geometry to prevent snagging in one instance will not necessarily avoid snagging in another installation. Given the overall objective of minimizing the number of parts required to satisfy all installation requirements, this presents a problem.

It is an object of the present invention to provide a stairlift rail which goes at least some way to addressing at least some of the drawbacks as outlined above; or which will at least provide a novel and useful alternative.

SUMMARY OF THE INVENTION

Accordingly the invention provides a unitary stairlift rail for fitment alongside a first edge of a staircase having an upper end and a lower end; wherein a line extending between said upper end and said lower end defines a slope of the staircase; said stairlift rail having an upper section to be aligned substantially parallel to said slope; a lower section extending from said upper section but angled downwardly with respect to said upper section, there being a junction between said upper section and said lower section said rail being characterized by including a bend when viewed in plan between said upper section and said lower section.

Preferably said bend comprises at least part of said junction and is configured to also rotate said rail in a vertical plane.

Preferably said lower section is aligned substantially vertically.

Preferably said upper section includes a second bend to further rotate said rail in a vertical plane.

Preferably said bend and said second bend are separated by a straight section of rail.

Preferably said bend defines an angle of between 5° and 20° when viewed in plan.

In a second aspect the invention provides a method of avoiding clash between a stairlift chair mounted on a carriage, and a staircase along which said chair moves guided by a unitary stairlift rail, said method being characterized in that it includes the step of configuring said rail to effect rotation of said carriage and chair in a downhill direction when said carriage and chair are in a position adjacent to a bottom end of said staircase.

Preferably said method comprises the use of the unitary stairlift rail as set forth above.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The various aspects of the invention will now be described with reference to the accompanying drawings in which.

DETAILED DESCRIPTION OF WORKING EMBODIMENT

Figure 1:
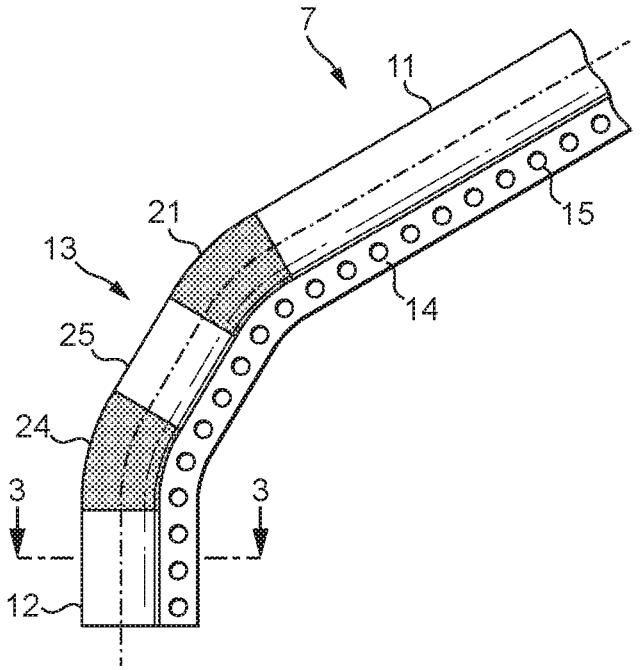
FIG. 1: shows a side elevation of part of a stairlift rail according to the invention.

This invention relates generally to a stairlift 5 for installation on a staircase 6, the stairlift including a unitary rail 7 mounted along one edge 10 of the staircase, a carriage 8 mounted on the rail, and a chair 9 mounted on the carriage. As used herein unitary rail means a rail formed from one or more sections of a single substantially uniform cross-section, joined end-to-end to form a single running support and is thus to be distinguished from stairlift rails formed from two spaced tubes, both of which contribute to the support and guiding of the carriage. In the particular form shown and described, the rail is formed from one or more sections of round tube joined end to end and is substantially as described in our European Patent 1 720 790 ('EP '790'). To this end the rail comprises an upper section 11 aligned substantially with the slope of the staircase 6, and a lower section 12 formed integrally with the upper section 11 but angled downwardly with respect to the upper section 11 through a junction 13 between the two sections. A tang 14 extends along the underside of the rail, the tang including apertures 15 into which the teeth of a drive sprocket (not shown) can engage to drive the carriage along the rail. The tang 14, which on upper rail section 11 projects vertically downwards, also provides a support surface to prevent rotation of the carriage 8 about the rail axis.

As described in EP '790 the lower section 12 terminates on the first tread 16 of the stairway, thereby minimizing or even eliminating the protrusion of the rail 7 at the lower end of the staircase. This then eliminates the need to provide a folding section or hinge at the lower end of the rail in order to avoid creating an obstruction at the foot of the rail.

The chair 9 includes a seat base 17, a backrest 18, and a footrest 19.

While the stairlift described in EP '790, is effective in eliminating the need for hinged or folded rail sections, with some stairlift geometries a problem can arise with the footrest 19 clashing with the staircase. This problem could be addressed in a number of ways by taking into account a number of factors including the relationship between rail height, the position of the pivot between the chair and the carriage, and the position of the footrest in relation to the staircase nosings. By way of example only, clashing could be avoided by pivoting the footrest 19 in a downhill direction relative to the remainder of the chair, by mounting the chair so that it is aligned in a downhill direction, and/or by substantially reducing the width of the footrest, however all of these solutions can negatively impact user safety and comfort and/or increase the complexity of the design. The clashing problem could also be addressed by other changes in configuration and/or geometry but any such changes would inevitably render the installation more bespoke or less standard. This is undesirable from a manufacturing viewpoint.

Figure 2:
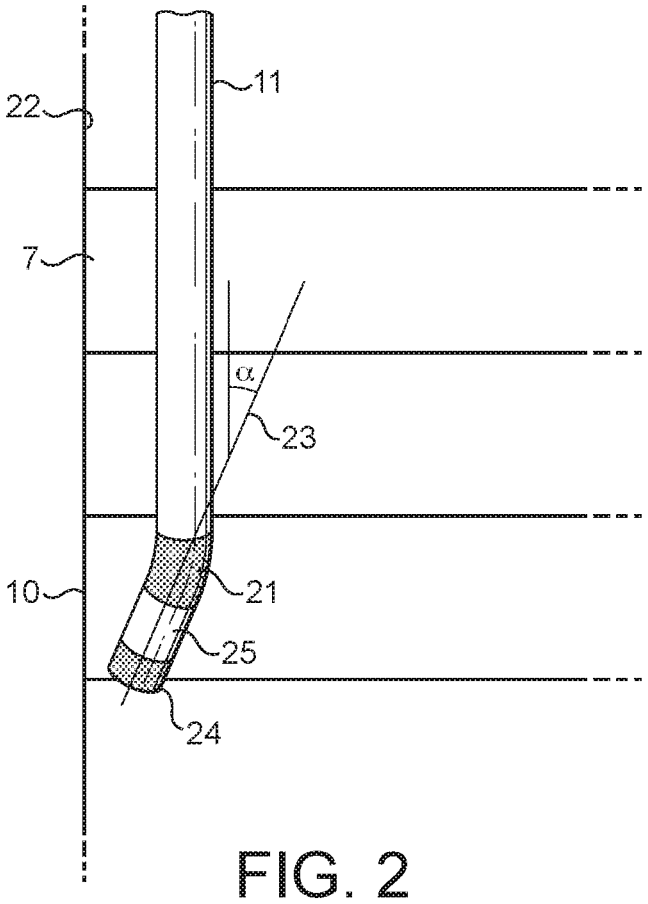
FIG. 2: shows a view from above of that which is shown in FIG. 1.

The present invention therefore addresses the problem by configuring the rail in the manner such that, as the carriage moves from the upper rail section 11 to the lower section 12, it is rotated a small amount in a downhill direction (as indicated by arrow 20) thereby providing clearance between the footrest 19 and the staircase 6. This is achieved by providing $\alpha$ shallow bend 21, the axis 23 of which, when viewed in plan as in FIG. 2, defines an angle $\alpha$ with vertical plane 22 passing through edge 10 of the staircase when viewed in plan.

It will be appreciated from FIG. 1 that bend 21 also increases the angle of the rail with respect to a horizontal plane. For example the bend 21 may increase the rail angle from (say) the 40° angle of the upper rail section 11 to around 65°. A further bend 24 is then provided to rotate the rail further to the vertical orientation of the lower rail section 12.

The bends 21 and 24 could conceivably be formed as one but, in the embodiment shown, are separated by a short straight section of rail 25.

Figure 3:
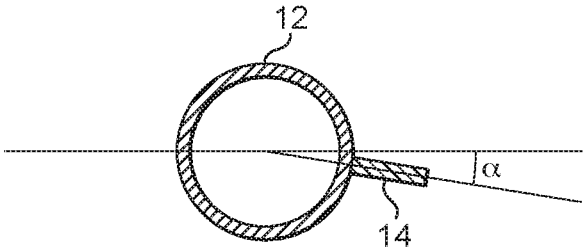
FIG. 3: shows a cross-section along the line 3-3 in FIG. 1.
Figure 4:
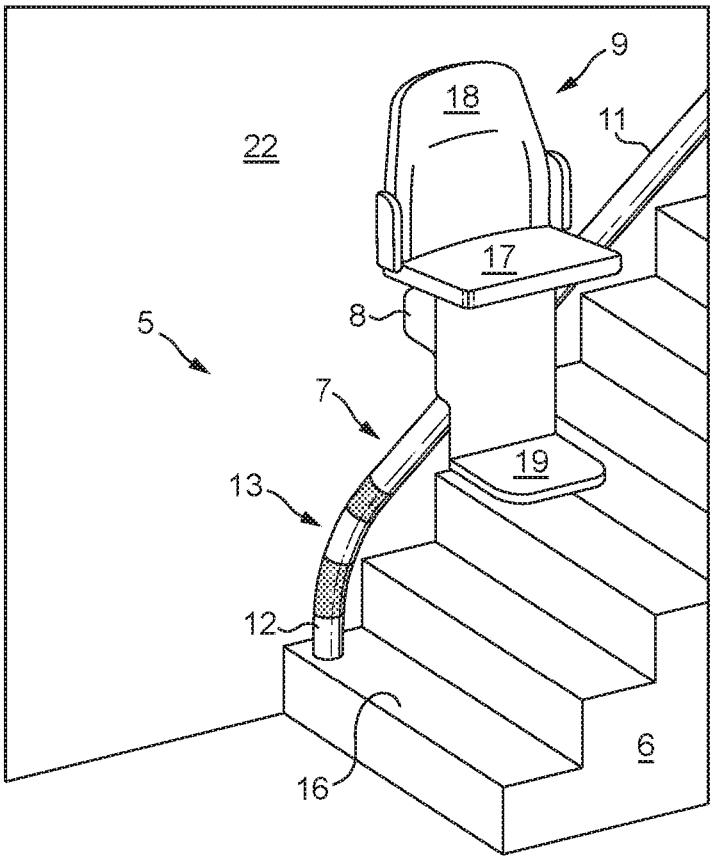
FIG. 4: shows an isometric view of part of a stairlift installation including a rail according to the invention.
Figure 5:
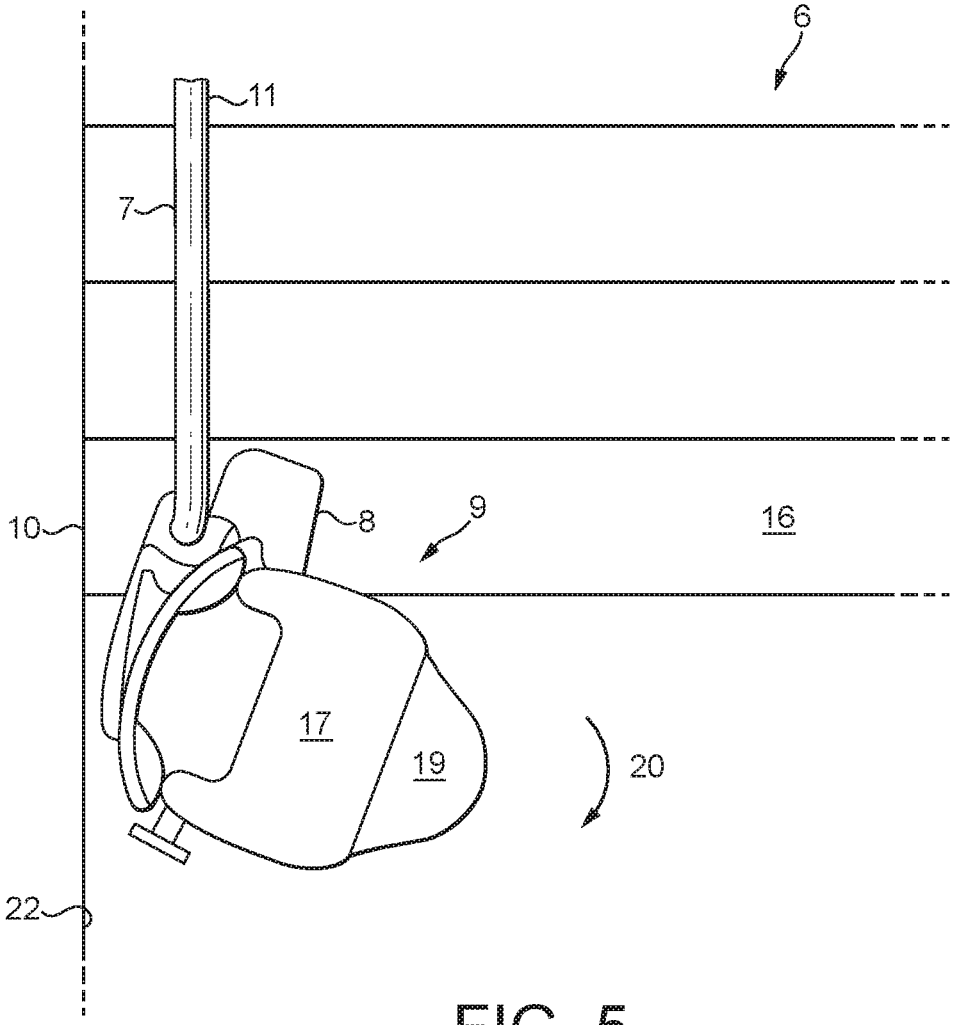
FIG. 5: shows a plan view of part of a stairlift installation including a rail according to the invention.

It will be appreciated that the tang 14 on the upper section 11 of rail will be oriented parallel to the plane 22 while the tang on bend 21 will be twisted through angle $\alpha$. The orientation of the tang on section 25, bend 24 and lower rail, section 12 is maintained at angle $\alpha$ to the plane 22, a cross-section through the lower rail section 12 being shown in FIG. 3.

Angle $\alpha$ will generally (but not necessarily always) depend on the particular installation. For example $\alpha$ is preferably in the range 5°-20° and may be nearer the lower end of the range if a degree of protrusion of the rail section 12, beyond the tread 16, can be accommodated. The dimensions of the riser and tread widths may also influence the establishment of angle $\alpha$.

It will thus be appreciated that the invention, at least in the case of the embodiment described here, is particularly advantageous in that if offers a stairlift rail design that eliminates clash between the chair and the staircase eliminated without the need to modify the chair or carriage in any way. Given that stairlift rails are invariably bespoke this reduces cost and significantly improves design and installation efficiency.

The invention claimed is:

1. A unitary stairlift rail for fitment alongside a first edge of a staircase having an upper end and a lower end, wherein a line extending between said upper end and said lower end defines a slope of the staircase, the unitary stairlift rail comprising:

an upper section to be aligned substantially parallel to the slope;

a lower section extending from the upper section but angled downwardly with respect to the upper section and terminating at the lower end; and a junction between the upper section and the lower section, the unitary stairlift rail, when viewed from above in plan view, includes a bend defining an angle in a range of 5° to 20° between the upper section and the lower section.

2. The unitary stairlift rail according to claim 1, wherein the bend comprises at least part of the junction and is configured to also rotate the alignment of the unitary stairlift rail in a vertical plane.

3. The unitary stairlift rail according to claim 2, wherein the junction includes a second bend to further rotate the alignment of the unitary stairlift rail in the vertical plane.

4. The unitary stairlift rail according to claim 3, wherein the bend and the second bend are separated by a straight section of the unitary stairlift rail, and the straight section is angled downwardly with respect to the upper section.

5. The unitary stairlift rail according to claim 1, wherein the lower section is aligned substantially vertically.

6. A stairlift installation including the unitary stairlift rail according to claim 1.

* * * * *